United States Patent [19]

Skjonberg

[11] Patent Number: 4,905,848

[45] Date of Patent: Mar. 6, 1990

[54] COORDINATED HOIST CONTROLLERS

[76] Inventor: Knut B. Skjonberg, 320 Artemisia Ave., Ventura, Calif. 93001

[21] Appl. No.: 202,367

[22] Filed: Jun. 6, 1988

[51] Int. Cl.[4] ..... B66C 13/06

[52] U.S. Cl. ..... 212/147; 212/153

[58] Field of Search ..... 212/147, 148, 153, 156

[56] References Cited

U.S. PATENT DOCUMENTS 3,043,444 7/1962 Melton ..... 212/147
3,107,791 10/1963 Michael ..... 212/147

FOREIGN PATENT DOCUMENTS 2053590 5/1972 Fed. Rep. of Germany ..... 212/147
3335402 4/1985 Fed. Rep. of Germany ..... 212/147
1178685 9/1985 U.S.S.R. ..... 212/147
1189794 11/1985 U.S.S.R. ..... 212/147

*Primary Examiner*—Sherman D. Basinger
*Assistant Examiner*—Stephen P. Avila
*Attorney, Agent, or Firm*—Michael I. Bak-Boychuk

[57] ABSTRACT

A control arrangement for a multiple hoist suspension system in which a count is maintained for the pulley turns on each hoist. When the pulley counts approach within a selected deadband, the desired end location the controls are then left open loop and the suspended article is free to drift by inertia. Several such end locations may be stringed together with the resulting alignment sequence determined by the deadband. In consequence closed loop servo dynamics are avoided and the forces are self-resolved within the width of the deadband.

1 Claim, 2 Drawing Sheets

COORDINATED HOIST CONTROLLERS

BACKGROUND OF THE INVENTION

1. Field of the Invention

The present invention relates to hoist controllers, and more particularly to parallel control systems for coordinating the movement of a plurality of hoists.

2. Description of the Prior Art

Automatic control over hoist movement has had extensive development in the past, particularly in the context of the transverse and extension movements of a single hoist.

Typically hoists suspended on overhead cranes are arranged for lateral translation both along and transverse to an overhead support track with the vertical dimension determined by the extension of the hoist. Since the foregoing axes of motion are substantially orthogonal very little cross-coupling results between the various motions, particularly since the motions are maintained at rates sufficiently low to minimize any cross product terms. Thus the prior art hoist controllers typically take the form of position controllers along the three orthogonal axes which more or less operate independently.

Occasionally, however, overhead cranes are useful to effect suspension alignment in three dimensions. For example, overhead stage lighting often entails the movement of lighting arrays which are sometimes tilted around one or two pivotal axes in the course of such alignment. Thus, occasions arise in which hoists, of necessity, are moved in groups which, in the course of their motion and extension, then define the vertical and angular alignment of the articles supported. To effect such alignment, three or more hoists are typically used in a single grouping and define by the extension therebetween the effective alignment of the article. Thus the extension of the hoists and their consequent angular alignment with respect to the overhead crane determines the effective alignment of the articles suspended. When the mass distribution of the suspended article is not known a closed loop arrangement combining all three hoists becomes mathematically an insurmountable problem. Accordingly, the preference is for effecting hoist control by way of point-by-point observation and it is a technique for queing point-by-point sequences into coherent movements that is disclosed herein.

SUMMARY OF THE INVENTION

Accordingly, it is the general purpose and object of the present invention to provide a multiple hoist controlling system in which the path to the desired end point is determined by prior, stored sequences of position.

Other objects of the invention are to provide a multiple hoist control system in which several hoists are simultaneously controlled.

Yet further objects of the invention are to provide a multiple hoist control system suspending an article and controlled for minimal angular path.

Briefly, these and other objects are accomplished within the present invention by providing a microprocessor based control system conformed to control two or more hoists simultaneously. Such hoists may be suspended from an overhead track and thus may be translated in unison along the coordinates of motion along said track. Preferrably, each of the hoists is offset from the others, thus defining a plane at the attachment thereof. The extendable end of each of the hoists are then secured to various points of a suspended article and thus the extension or contraction of any one of the hoists will produce both linear and pivotal motion at the article. More importantly, the summation of the suspension forces will vary for all instances at which the vertical position of the hoist suspension does not coincide with the vertical position of their attachment to the article.

Thus, concurrent with any extension and contraction of a hoist in the hoist grouping, lateral translations will occur in the suspended article as result of the unbalanced lateral force created. Of course, such lateral translation resolves lateral stresses and occurs only in conjunction with increased suspension stresses.

In consequence, closed loop control over multiple hoist extension entails force summations and dynamic effects of exceeding complexity. Simply, each twist, when conformed as a closed loop, will result in at least a second order (quadratic) effect on the mass suspended. When expanded to multiple hoists the combined product of closed loop motion becomes inordinately complex, particularly when the gain and therefore system accuracy are increased.

Those skilled in the art will appreciate that any dynamic response of a closed loop system will progress towards instability with increased gain. Moreover, the stability derivatives will include expressions of the mass and inertia of the article suspended along with the suspension geometry of the hoists. Thus, as each new article is lifted new stability problems arise if classical closed loop servo control is applied.

Accordingly, the instant invention provides for a selectable dead band in the hoist servo loops along with a selectable coast timer to accommodate the dead band. Simply, the hoist servo loops are maintained closed only up to the dead band and thereafter are open looped for the time interval necessary to accommodate the mass inertia. In this manner the complex dynamics of a multiple hoist combination are avoided. Within this dead band precision the translation of the article between positions is achieved by end point coordinates.

Thus, the present system effects translation by a series of end points, in a novel control arrangement which strings together individual, balanced vertical positions to obtain the desired path within the limits of the dead band. This path of vertical motion can then be carried out at any horizontal coordinate to allow the article in various selected alignments at any desired point.

This convenience is particularly useful in suspending items like lighting arrays over stages or in controlling the deployment of articles in the course of any assembly process.

DESCRIPTION OF THE PREFERRED EMBODIMENT

The example set forth herein illustrates the novel hoist control system in conjunction with stage lighting arrays. While thus illustrated it is to be noted that the use set out is exemplary only and various alternatives to this use are both proper and contemplated. For example, uses like those entailed in aligning articles in the course of any assembly process or the alignment of tools from overhead suspension are accommodated with the same parameters and no intent to limit the scope of the invention to the choices exemplified is expressed herein.

Figure 1:
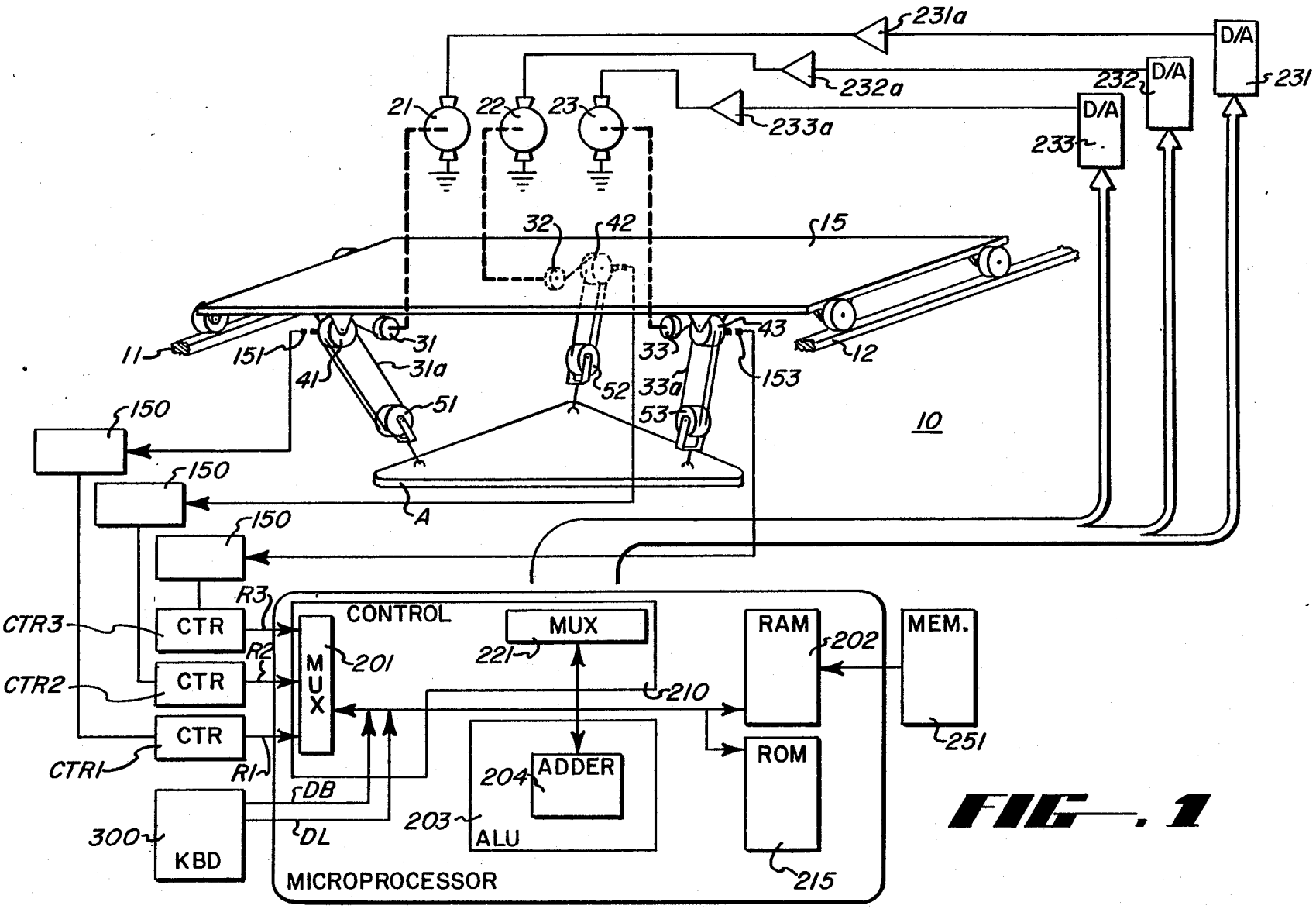
FIG. 1 is a diagrammatic illustration of a hoist control system arranged in accordance with the present invention.

As shown in FIG. 1, the inventive system, generally designated by the numeral 10, comprises an overhead crane arrangement characterized by the parallel rails 11 and 12 on which a wheeled framework 15 is suspended. Framework 15, in turn, supports a plurality of hoist motors illustrated herein as motors 21, 22 and 23, each connected to take up or to extend hoist cable stored on corresponding cable reels 31, 32 and 33. The cable from each of the reels 31, 32 and 33, shown as cables 31*a*, 32*a* and 33*a* is then directed over a corresponding upper sheave 41, 42 and 43 forming pulley loops with the corresponding lower sheaves 51, 52 and 53 then supporting the suspended article A. Of course, force multiplication may be effected by conventional multiplying means and the pulley pairs illustrated herein are thus exemplary only.

Accordingly, any pulley arrangement by which motion of a load can be effected may be used herein without loss of generality.

Figure 2:
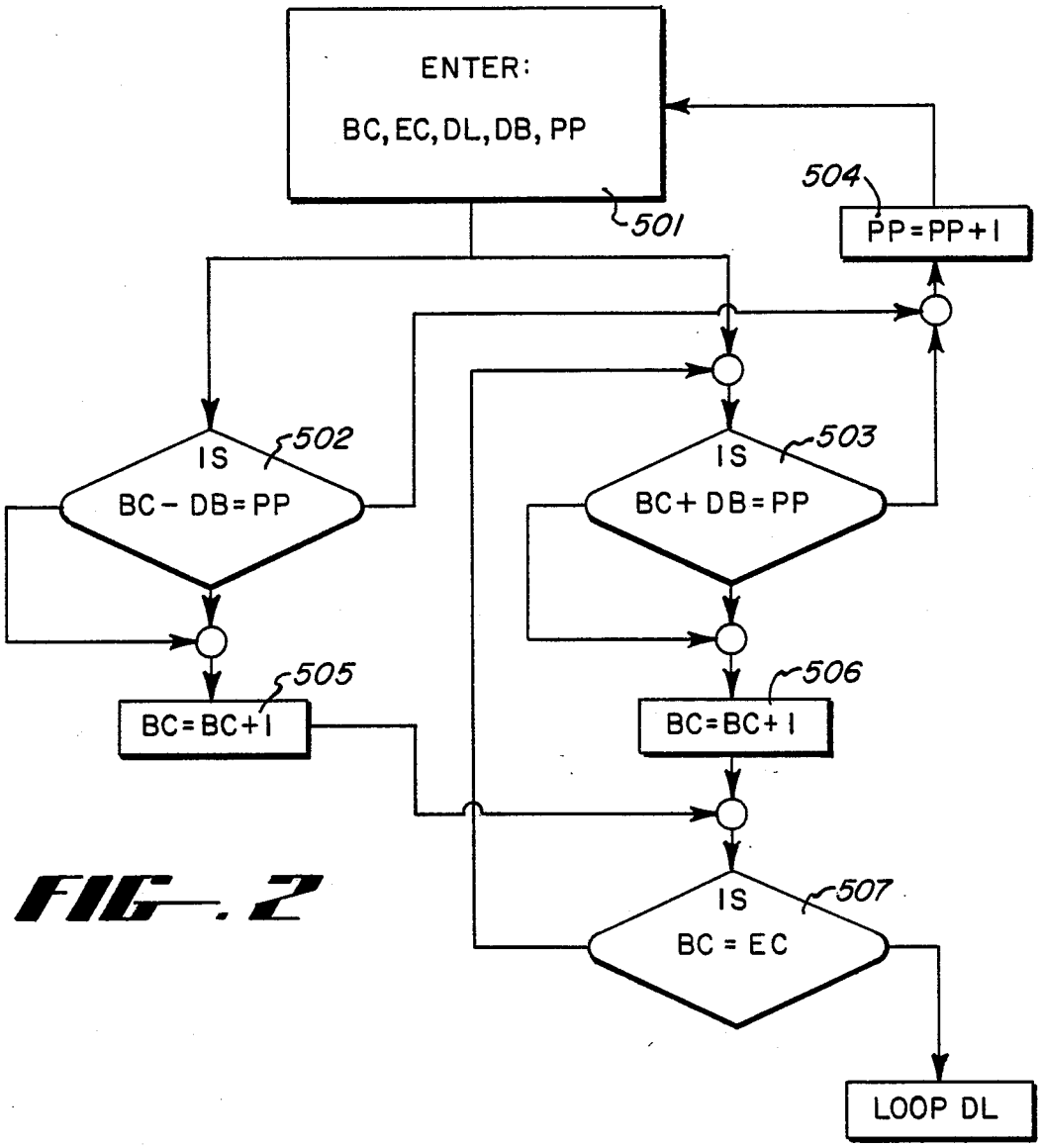
FIG. 2 is a detail illustration, in diagrammatic form, of a signal pick-off useful with the present invention.

By reference to FIGS. 1 and 2, each of the upper sheathes 41, 42 and 43 may be provided with ferro-magnetic slugs 141, 142 and 143 aligned to rotate with the sheave adjacent reluctance pick-offs 151, 152 and 153. Pick-offs 151, 152 and 153 then each connect, across their signal conditions stages 150, to a corresponding counter CTR1, CTR2 and CTR3 in which the pulse count of the slug passage is accumulated. For the use contemplated herein counters CTR1, CTR2 and CTR3 are each provided with a clear and reset lines R1, R2 and R3 and are each connected for parallel output into a common multiplexer (MUX) 201 at the input of a processing system 200.

As shown in detail in FIG. 2, each signal conditioning stage 150 includes at its input a magnetic sensor 651, of the type comprising a magnetized loop 652 around which a coil 653 is wound and connected to the input of a differential driver 654. Alternatively, Hall effect devices, optic or photo encoders or other implementations (not shown) may be used for the purpose of generating an input signal. The outputs S of the differential driver 654 are then collected at the input of a differential receiver 655 which, through a photo coupler 656, then provides the pulse signal to the corresponding counter CTR1 (and by same example CTR2 and CTR3).

One should note that the foregoing illustration describes the signal conditioning at the pickoff 151. By similar connection pickoffs 152 and 153 are conditioned and their implementation shall not be repeated.

Processing system 200 may be variously implemented and may preferrably take the form of any conventional microprocessor, such as the microprocessor sold under the Model Number 6809 by Motorola, Inc. In such conventional form the processing system includes an operating memory 202, preferrably in the form of a random access memory (RAM), an arithmetic logic unig (ALU) 203 which preferrably entails an added 204, and a control stage 210. Of course, the processing system of this form will also include a program memory variously implemented, and shown herein as a program ROM (read only memory) 215 onto which the various program instructions to be described hereinbelow are impressed. As is commonly practiced in the art such a program memory will execute instruction sequences entailing the above-described operative features of the processing system. Moreover, the control 210 in its conventional form will include an output multiplexer (MUX) 221 which distributes the separate digital outputs to external digital-to-analog (D/A) converters 231, 232 and 233 which then, through corresponding servo amplifiers 231*a*, 232*a* and 233*a* drive the motors 21, 22 and 23. Of course, servo amplifiers 231*a*, 232*a* and 233*a* entail saturation limits which effectively result in on-off saturated inputs to their corresponding motors. In the course of this operation RAM 202 may be inscribed with the necessary coordinates to which the various sheaves 41, 42 and 43 are to be brought. These coordinates may be inscribed from a permanent memory record 251 or may be set in the course of execution of the instruction cycle in ROM 215.

More importantly, through the use of an external keyboard 300 manual, step-by-step, positioning of each hoist may be effected. This manually positioned sequence may then, once again, be stored in the permanent memory 251 as a string of beginning and end cues BC and EC which are thereafter useful in the course of automated execution described below.

In the course of execution of each instruction cycle the stored coordinates in RAM 202 are sequentially brought up to the added 204 to be compared against the multiplexed output of counter CTR1, CTR2 and CTR3. Added 204, therefore, forms the summing node of a multiplexed servo system and its output to multiplexer 221 is then useful for avrious functions. In the first instance the adder output may be sized to add only a selected gorup of most significant bits from multiplexer 201 and memory 202. This is under the control of an external input of a dead band DB. A second, selectable input may be in the form of idle do loop execution DL effecting a selectable idle do loop delay. Of course, these inputs may be effected through the keyboard 300 and thus appear as external inputs to a program sequence executed in the microprocessor.

The foregoing operations are set out in the context of a standard microprocessor. One should note that similar implementations may be achieved in various choices of integration, as for example by small scale integration (SSI) or very large scale integration (VLSI) and the example, therefore, is not intended as a limitation. Thus, the foregoing system may be variously implemented for execution in the course of which escapement values of one hoist relative the others is accommodated.

Figure 3:
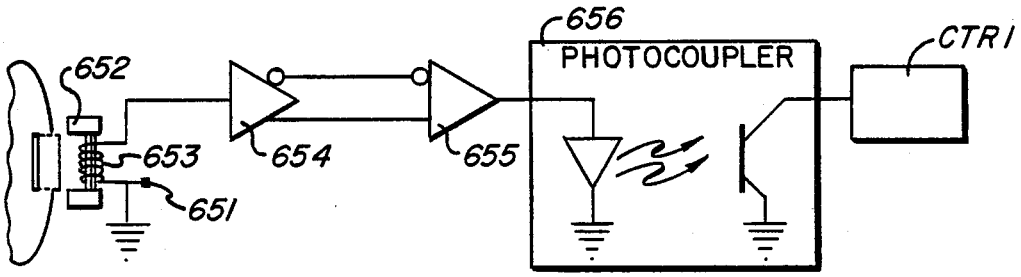
FIG. 3 is a flow chart effected in accordance with the present invention.

The foregoing may be implemented in terms of instruction flow chart set out in FIG. 3, and implemented in ROM 215. In this flow chart the first step 501 receives and enters the external inputs including the beginning cue BC, end cue EC, the do loop delay DL, the dead band DB and the pulley position PP. The entry is then compared in the negative dead band comparison 502 and the positive dead band comparison 503. If the pulse position is outside the positive or negative dead band range the next pulse count is brought up (the other pulleys) in step 504. If not, the next cue is read in for execution in steps 505 and 506. If the next cue is the end one (step 507) then the delay loop DL is invoked in step 508 and the hoist is left open loop to drift to its settling value during which the pulse count continues to be maintained.

Thus loop closure is only effected when the pulse count PP is outside the dead band DB of the system. Within this deadband no loop closure occurs unless the next cue is outside the limits thereof. Accordingly, a plurality of hoists may be concurrently resolved without incurring the dynamic instabilities that may manifest themselves close to null.

In consequence a difficult parallel central problem is reduced to sequential form which may then be manually adjusted by step increments in each hoist loop.

Obviously, many modifications and changes may be made to the foregoing description without departing from the spirit of the invention. It is therefore intended that the scope of the invention be determined solely by the claims appended hereto.

What is claimed is:

1. A control system for coordinating the extension of a plurality of hoists cooperatively suspending a single article, comprising:

a horizontally moveable overhead platform;

a plurality of extendable hoists suspended from said platform at the respective one ends thereof and connected at the respective other ends thereof to said single article;

a corresponding plurality of sensing means each mounted adjacent a corresponding one of said extendable hoists for sensing the extension of the corresponding one of said hoists and for producing a sensing signal in the form of a sequence of sensed electrical pulses each said sensed pulses being indicative of an integer unit of extending dimension of the adjacent one of said hoists;

control means connected between said sensing means and said hoists for receiving said sensing signals from said sensing means and for accumulating said sensed pulses of said sensing signals, said control means including memory means conformed to store selected reference count sequences of reference pulses, comparison means conformed to receive said reference counts in predetermined sequences of said reference pulses from said memory means and said sensed pulses selected in preselected sequences for producing an output signal indicative of the difference therebetween; and a plurality of motive means each respectively engaged to a corresponding one of said hoists and conformed to receive said output signal for extending said hoists in response to said output signal.

* * * * *